United States Patent [19]

Hadtke

[11] 4,306,687

[45] Dec. 22, 1981

[54] CARDBOARD CONTAINER FOR DISPENSING ROLL OF SHEET MATERIAL

[75] Inventor: Frederick Hadtke, New Providence, N.J.

[73] Assignee: Lever Brothers Company, New York, N.Y.

[21] Appl. No.: 151,509

[22] Filed: May 20, 1980

[51] Int. Cl.[3] ..... B65H 19/00

[52] U.S. Cl. ..... 242/55.53; 242/138; 229/17 S

[58] Field of Search ..... 242/55.3, 55.53, 137–138; 206/395, 396, 408, 409; 225/48–52; 229/16 R, 17 S

[56] References Cited

U.S. PATENT DOCUMENTS

| | | | |
|---|---|---|---|
| 2,458,844 | 1/1949 | Foote | 306/396 |
| 2,890,822 | 6/1959 | Lee et al. | 206/409 |
| 3,121,542 | 2/1964 | Van Dyke et al. | 242/55.53 |
| 3,166,187 | 1/1965 | Araujo | 229/17 S |
| 4,238,065 | 12/1980 | Ragsdale | 225/47 |

*Primary Examiner*—Leonard D. Christian
*Attorney, Agent, or Firm*—Philip Sands

[57] ABSTRACT

Cardboard container for dispensing a roll of sheet material consisting of a box with a slotted top through which is dispensed material fed from a supply roll contained in the box. The container is constructed of a single sheet of paperboard folded and slotted so as to provide a centering device for the supply roll when the paperboard is folded to form a box.

5 Claims, 4 Drawing Figures

FIG. 1
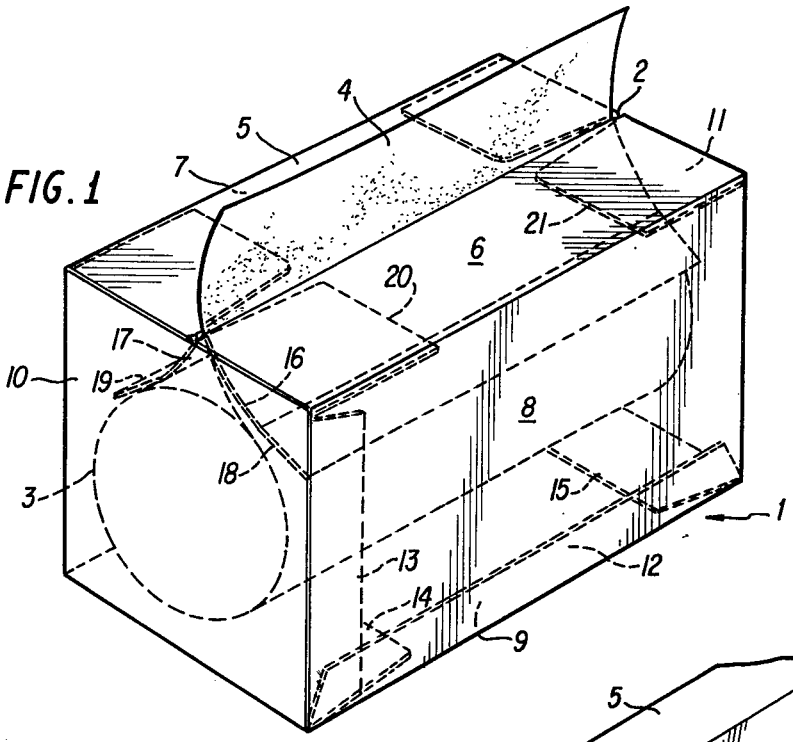
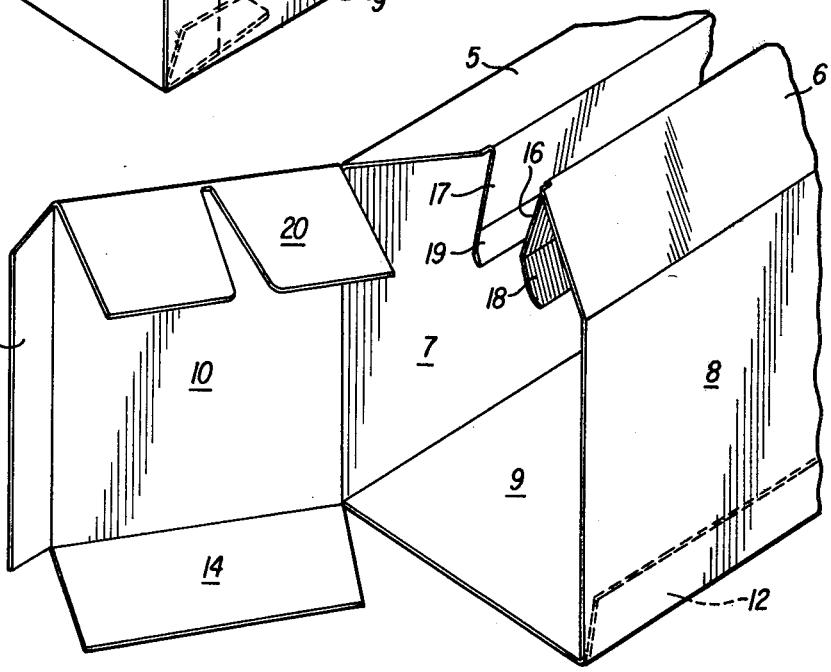
FIG. 2
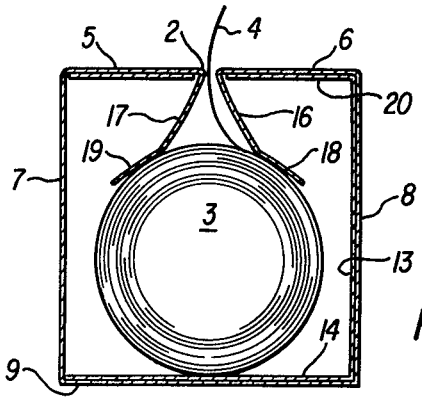
FIG. 3

CARDBOARD CONTAINER FOR DISPENSING ROLL OF SHEET MATERIAL

BACKGROUND OF THE INVENTION

This invention relates to a paperboard dispensing container for a roll of sheet material, such as paper toweling and the like, which is packaged therein. More particularly, the invention has reference to a dispensing container that is adapted to maintain, in accessible disposition, a portion of the sheet material stored therein in order to facilitate withdrawing a desired length from the roll.

The conventional cartons in which are packaged rolls of paper towels, waxed paper, metal foil and commonly employed rolled materials for domestic use do not always maintain the end of the roll in an easily accessible position because as the roll is consumed and becomes smaller, it falls about in the container and in doing so, sometimes withdraws its leading edge into the interior of the container.

The present invention provides, by a simple construction, a container which will hold the roll of sheet material in a centered position, even as its size decreases, and the thus positioned roll will maintain its leading edge exteriorily exposed for ready removal.

SUMMARY OF THE INVENTION

According to this invention, there is provided a cardboard container for dispensing sheet material from a wound supply roll thereof stored in the container, said container being formed of a single piece of cardboard folded into a rectangular box having sides and ends, one of said sides having a slot through which the free end of said sheet material projects, formed therein by positioning flaps resiliently folded into said container, said flaps forming means to maintain said supply roll in place within the container as sheet material is dispensed therefrom and said supply roll becomes smaller.

BRIEF DESCRIPTION OF THE DRAWINGS

Referring to the accompanying drawings:

FIG. 1 is a perspective view of the container of this invention, and the roll of sheet material positioned therein;

FIG. 2 is a fragmentary perspective view of an open end of the container of FIGS. 1 and 3 before the roll of sheet material is positioned therein;

FIG. 3 is a cross-section view of the container of FIG. 1;

DETAILED DESCRIPTION OF THE DRAWINGS

Figure 4:
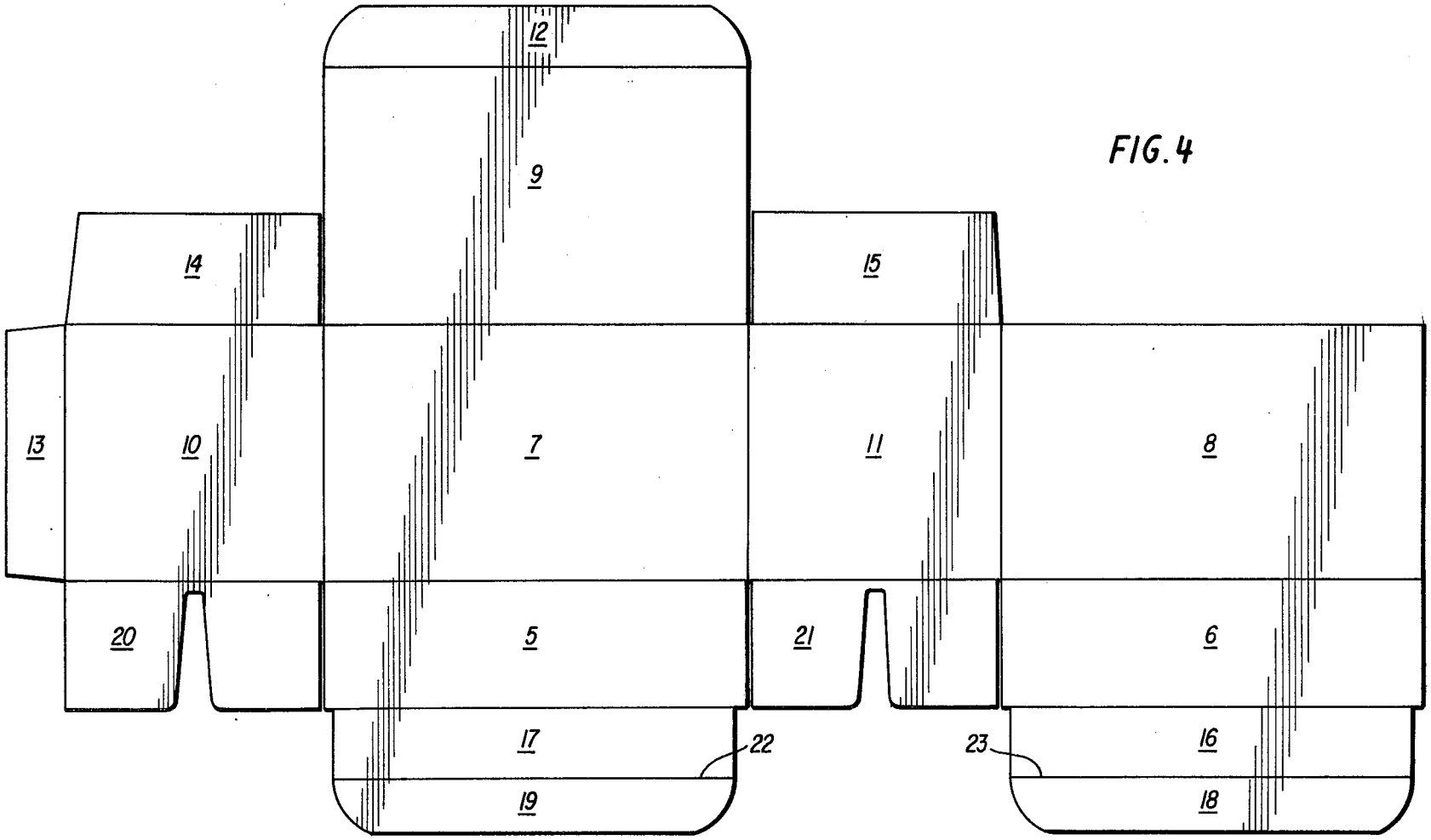
FIG. 4 is a plan view of the blank from which the container of FIGS. 1–3 was formed.

There is shown in perspective view in FIG. 1 of the drawings a dispensing container of this invention indicated generally by reference numeral 1. In the preferred form shown in the drawings, the container 1 is in the form of a rectangular, roll-accommodating box made of foldable cardboard or paperboard, fiberboard or like material. The container 1 has a slot 2 formed in its upperface 5, 6 and houses a supply roll 3 of sheet material to be dispensed through the slot 2 by the leading edge 4 of the roll 3.

The construction of the container may be more easily understood from FIGS. 1, 2 and 3. These figures each show an upper face of the container formed by upper portions 5 and 6 on opposite sides of the slot 2, side faces 7 and 8, bottom face 9 and end faces 10 and 11. A securing flap 12 extends from a side of bottom face 9 and a bonding flap 13 extends from a side of face 10. Tuck flaps 14 and 15 extend from the lower ends of 10 and 11, respectively. To complete the structure of the container, as best shown by the blank layout in FIG. 4, there is further provided a flap 18, extending from the opposite side of a flap 16 which extends from a side of upper portion 6 and a flap 19 extending from the opposite side of a flap 17 which extends from a side of upper portion 5. Also attached to the ends 10 and 11, respectively, are bifurcated tuck flaps 20 and 21, the function of which will be more fully described hereinafter.

The construction of the container of the instant invention may be more easily understood by reference to FIG. 4, which shows the blank from which the container is formed, and to FIGS. 1, 2 and 3, which show how the container is assembled.

As shown in FIG. 4, the container is formed from a single irregularly shaped flat sheet of cardboard having, as successive portions in one direction (numbered to correspond to the corresponding elements of the container formed therefrom) a first rectangular portion 8, joined on a short side thereof to a first square portion 11 of the same width, which in turn, is joined on its opposite side, to a second rectangular portion of the same width and the same length as the first rectangular portion 8 and which is joined, in turn, on its opposite side to a second square portion 10 of the same width. Extending from the opposite side of the latter portion is a narrow slightly tapered bonding flap 13 of the same length at its juncture as the width of the square and rectangle portions. Joined along a long side of the second rectangular portion 7 is a third rectangular portion 9 of the same length and slightly greater width. Extending from the opposite long side of third rectangular portion 9 is a thin slightly tapered flap 12 of the same length at its juncture. Joined to the opposite long side of the second rectangular portion 7 is a fourth rectangular portion 5 of the same length and about half the width. Extending from fourth rectangular portion 5, in the opposite direction from second rectangular portion 7, is a thin intermediate flap portion 17, from which a second thin outer flap portion 19 extends in the opposite direction from portion 5. Flap portions 17 and 19 each are slightly shorter than and about half the width of fourth rectangular portion 5. Similarly, extending from the corresponding long side of first rectangular portion 8, are a correspondingly dimensioned fifth rectangular portion 6, a thin intermediate flap 16 and an outer flap 18. The intersection of each of the foregoing portions and flaps is creased to facilitate folding inwardly, i.e., away from the surface of the blank which is to form the exterior surface of the container.

As shown in FIG. 1, the container 1 is formed by folding portions 10, 7, 11 and 8 at their intersections until bonding flap 13 is positioned against the inner surface of first rectangular edge portion 8 opposite that joining second rectangular portion 7. It can be secured thereat by staples or adhesive (not shown). Bifurcated flaps 20 and 21 are folded inwardly until perpendicular to portions 7, 8, 10 and 11, which now form the side and end walls of the container. Flap portions 17 and 19 are urged through the slots of bifurcated flaps 20 and 21 until portion 5 is perpendicular to portions 7, 8, 10 and 11 and flaps 17 and 19 are within the container and point inwardly and toward the inner face of second rectangular portion 7. Flap portions 16 and 18 are similarly urged through the slots of flaps 20 and 21 until portion 6 is perpendicular to portions 7, 8, 10 and 11 and flap portions 16 and 18 point inwardly and toward the inner surface of first rectangular portion 8, thereby forming the upper face of container 1 and slot 2 therein. The roll 3 of sheet material is positioned between flaps 16 and 18 and 17 and 19, respectively, with its free end extending therebetween and through slot 2. Flaps 14 and 15 are then folded inwardly, parallel to portions 7, 8, 10 and 11, and portion 9 is folded toward portion 8 until flap 12 can be inserted between the edges of flaps 14 and 15 and the inner wall of first rectangular portion 8. Flap 12 can, if desired, then be secured to the inner face of first rectangular portion 8 by conventional means (not shown), e.g., staples or adhesive.

As shown in FIGS. 1 and 3, slot 2 is formed by the upper portions 5 and 6 having their respective flaps 16 and 18 and 17 and 19 resiliently folded inwardly and secured by the bifurcated tuck flaps 20 and 21. The bonding flap 13 is attached to the side 8 by adhesive or other standard practice. The tuck flaps 14 and 15 are folded in, adjacent the bottom 9 which is held in place by the securing flap 12.

The additional flaps 16, 17, 18 and 19 which form the slot 2 and extend into the container provide a guide and centering means for maintaining the supply roll 3 in place. A supply roll restricted by these flaps will maintain its leading edge through the slot 2 and thus enable the user to readily grasp it.

As will be readily appreciated, in an alternative embodiment (not shown), flaps 18 and 19 may be eliminated simply by eliminating fold lines 22 and 23 and correspondingly extending the width of flaps 16 and 17.

A container formed from the blank shown in FIG. 4 and assembled as shown in FIGS. 1 and 3 will provide a container having a longitudinal dispensing slot 2 extending the length of a long side thereof and formed by the resilient folding inwardly of flaps 16 and 17. The slot 2 will be maintained in its proper size and position by the bifurcated flaps 20 and 21. The bifurcated flaps 20 and 21 add strength and help maintain the container in shape. The relationship of flaps 20 and 21 to flaps 16 and 17, which are the means which maintain the supply roll in place, can be more readily seen in FIG. 3. The flaps 16 and 17 are able to maintain the supply roll 3 centered because they are formed by resilient folding from the upper portions 5 and 6. The resiliency of that fold coupled with the constraint provided by the bifurcated flaps 20 and 21 provides the means to hold the supply roll in place and maintain the leading edge thereof projecting through slot 2 and available for use.

As will be apparent, to avoid the necessity of cutting off lengths of roll 3 with a pair of scissors, the sheet material can be transversely perforated periodically along its length to facilitate tearing off segments thereof.

To ensure that an end portion of roll 3 projects at all times through slot 2 and/or to facilitate tearing segments therefrom, upper portion 5 or 6 can be provided, proximate its juncture with side 7 or 8, respectively, with a conventional serrated metal or cardboard tearing guide means (not shown) employed on conventional dispensing containers for rolls of plastic film, waxed paper and aluminum foil. Such a guide means typically is a thin strip of metal of the length of the container, serrated on its leading edge and affixed at its ends only to the container proximate an edge of a side wall thereof, thus providing a dispensing slot through which the end of the roll is inserted.

Although the container of this invention has been described as a rectangle box with a slot extending the length of a long side thereof, it will be apparent that the container can also be a square box or other similar configuration.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A cardboard container for dispensing sheet material from a wound supply roll thereof stored in the container, said container being formed of a single piece of cardboard folded into a rectangular box having sides and ends, one of said sides having a slot through which the free end of said sheet material projects and formed therein by positioning flaps resiliently folded into said container, said flaps forming means to maintain said supply roll in place within the container as sheet material is dispensed therefrom and said supply roll becomes smaller, said ends being provided with bifurcated tuck flaps, said bifurcated flaps passing on each side of said positioning flaps folded into said container to constrain the positioning flaps within said container.

2. A container as in claim 1 wherein said positioning flaps resiliently folded into the container have a longitudinal crease in the center thereof urging them away from each other.

3. A container blank adapted to be formed into a container of claim 1, consisting essentially of an irregularly shaped flat sheet of cardboard having, as successive portions in one direction, a first rectangular portion joined on a short side thereof to a first square portion of the same width, which in turn is joined on its opposite side to a second rectangular portion of the same width and the same length as the first rectangular portion and joined, in turn, on its opposite side to a second square portion of the same width and having a narrow slightly tapered bonding flap of the same length at its juncture as the width of the square and rectangle portions, extending from the opposite side of the second square portion; a third rectangular portion of the same length and slightly greater width as the second rectangular portion and joined along a long side thereof; a thin slightly tapered flap of the same length at its juncture as the third rectangular portion and extending from the opposite long side thereof; a fourth rectangular portion of the same length and about half the width as the second rectangular portion and joined to the opposite long side thereof; a thin intermediate flap portion extending from the fourth rectangular portion in the opposite direction from the third rectangular portion and from which a thin outer flap portion extends in the opposite direction from the fourth rectangular portion; the intermediate and outer flap portions each being slightly shorter than and about half the width of the fourth rectangular portion; a correspondingly dimensioned fifth rectangular portion, a second thin intermediate flap and a second outer flap similarly extending from the corresponding long side of first rectangular portion, the intersection of each of the foregoing portions and flaps being creased to facilitate folding the blank inwardly away from the surface thereof which is to form the exterior surface of the container.

4. A container for dispensing sheet material wound in a roll in the container, the container comprising a plurality of walls interconnected to one another and forming an enclosure in which a cylindrical roll of sheet material is both longitudinally and diametrally constrained loosely, one of said walls having a slot formed therein and extending longitudinally of said roll of sheet material for accommodating and making accessible externally of the container a leading unwound portion of said sheet material, and resilient means connected to at least one of said walls for continually pressing said roll of sheet material against another of said walls and thereby constraining said roll of sheet material in a generally stable angular disposition against inadvertant unwinding substantially independently of any diametral size reduction said roll may undergo, said resilient means being connected to said one wall in which said slot is formed, said resilient means comprising at least a first flap secured to one longitudinal edge of said slot and extending substantially the full longitudinal length of said slot, said first flap having a width transversely of said edge of said slot of sufficient span to contact said roll of sheet material and urge it against at least a wall of said container opposite said one wall in which is formed said slot, and first scored transition means interconnecting said first flap to said one longitudinal edge of said slot for urging said flap resiliently into continual contact with said roll, said resilient means further comprising a second flap similar in size and configuration to said first flap and secured to the opposite longitudinal edge of said slot, and second scored transition means interconnecting said second flap to said opposite longitudinal edge of said slot for urging said second flap resiliently into continual contact with said roll, said first and second flaps being each divided into two portions interconnected to one another through the intermediary of respective additional scored transition means, and including bifurcated means at each longitudinal end of said slot for constraining respective longitudinal end portions of said flaps inwardly of said container.

5. A container as claimed in claim 4, wherein the entirety of said walls and flaps are formed from a single blank of material appropriately scored to define the respective walls and flaps.

* * * * *